United States Patent [19]

Hayes

[11] 4,406,511

[45] Sep. 27, 1983

[54] FLAT CABLE CONNECTOR STRAIN RELIEF

[75] Inventor: Earl J. Hayes, Mechanicsburg, Pa.

[73] Assignee: AMP Incorporated, Harrisburg, Pa.

[21] Appl. No.: 287,951

[22] Filed: Jul. 29, 1981

[51] Int. Cl.[3] ..... H01R 13/58

[52] U.S. Cl. ..... 339/103 M; 339/17 F; 339/176 MF

[58] Field of Search ..... 339/17 F, 176 MF, 103 M, 339/107, 97 P

[56] References Cited

U.S. PATENT DOCUMENTS

| | | | |
|---|---|---|---|
| 3,149,896 | 9/1964 | Hall | 339/17 F X |
| 3,639,891 | 2/1972 | Anhalt | 339/99 R |
| 3,691,509 | 9/1972 | Krol | 339/17 F X |
| 3,851,294 | 11/1974 | Palazzetti et al. | 339/176 MF X |
| 3,904,261 | 9/1975 | Cooney | 339/17 F |
| 3,989,336 | 11/1976 | Rizzio | 339/74 R |
| 4,172,626 | 10/1979 | Olsson | 339/17 F |
| 4,211,466 | 7/1980 | Reynolds | 339/176 MF |

*Primary Examiner*—Eugene F. Desmond

*Attorney, Agent, or Firm*—Frederick W. Raring

[57] ABSTRACT

A removable strain relief for flat multi-conductor cable connectors is disclosed. The strain relief comprises a rigid body portion having at least two cable-retaining ears extending therefrom which engage openings in a flat cable inserted into the connector. Latching arms flexibly connected to the body portion ends engage latching shoulders on the connector housing endwalls and permit the strain relief to be inserted on or removed from the connector.

10 Claims, 7 Drawing Figures

FLAT CABLE CONNECTOR STRAIN RELIEF

FIELD OF THE INVENTION

This invention relates to a strain relief mountable on a multi-contact electrical connector for flat multi-conductor cable.

BACKGROUND OF THE INVENTION

When the conductors in a flat cable must be removably connected to conductors on a circuit board, it is common practice to use multi-contact electrical connectors of the type comprising an insulating housing having a cable-receiving face and a rearward face, upper and lower sidewalls and endwalls extending between the faces, a cable-receiving trough extending into the housing from the cable-receiving face, and a plurality of contact terminals mounted in the trough, the terminals being arranged in a row extending between the endwalls so that the side-by-side conductors in the flat cable are contacted by the terminals when the cable is inserted into the trough. U.S. Pat. No. 3,989,336, U.S. Pat. No. 3,629,787 and U.S. Application Ser. No. 214,859, filed Dec. 10, 1980, all disclose such connectors.

An essential performance requirement of these connectors is that the flat cable not be damaged during insertion into the connector by an excessive resistive force produced by the contact terminals. Providing a connector with low insertion force, however, undesirably reduces the cable retention capacity of the connector, thereby permitting the cable to be disengaged from the connector upon application of a relatively small tensile pull on the cable. This may be unsafe under certain operating conditions.

One solution has been to incorporate strain relief means into the connector. The connector shown in U.S. Pat. No. 3,989,336 has strain relief ears on a flap which is hinged to the connector housing. These ears extend into cable openings to secure the cable in the connector housing. While this type of strain relief is undoubtedly effective, it is relatively complex and would be expensive to manufacture. Also, because strain relief is not required in all applications, fabrication of two types of connectors, one with and one without strain relief, would be necessitated. In addition, when a connector without strain relief is chosen for a particular application, but it is later discovered that strain relief is required, the entire connector must be removed and a new one installed having the strain relief feature. The present invention is directed to the achievement of a strain relief and connector for flat cable in which the strain relief is separable from the connector housing.

A strain relief and connector in accordance with the invention comprises a rigid body portion which is disposed against the upper sidewall of the connector housing. The body portion has ends which are adjacent to the housing endwalls and a forward edge adjacent to the cable-receiving face. Disposed against the endwalls are latching arms that have latching portions which are in engagement with latching shoulders on the endwalls. Flexible neck portions connect the latching arms to the ends of the body portion and permit outward movement of the latching portions from the endwalls so that the latching portions can be disengaged from the latching shoulders. At least two cable-retaining ears extend laterally from the forward edge of the body portion to free end portions which are received in openings in the cable.

U.S. Pat. No. 4,172,626 discloses a strain relief that is separable from a connector for flat cable. The connector is a connector clip having a row of cantilever springs resiliently biased against the circuit board connectors. A strain relief halter used with this connector clip as disclosed, however, is not adaptable to a connector of the type comprising an insulating housing having a plurality of terminals mounted therein.

A further advantageous feature of the present invention not available in any prior art connector having a strain relief is an overload release mechanism. Upon application of a tensile pull on the cable of a prior art connector, the strain relief retained the cable in the connector until the cable, the connector, and/or the strain relief were damaged. The present invention provides a mechanism whereby the strain relief disengages from the connector housing upon application of a predetermined tensile pull so that such damage is prevented.

DETAILED DESCRIPTION OF THE PREFERRED EMBODIMENT

Figure 1:
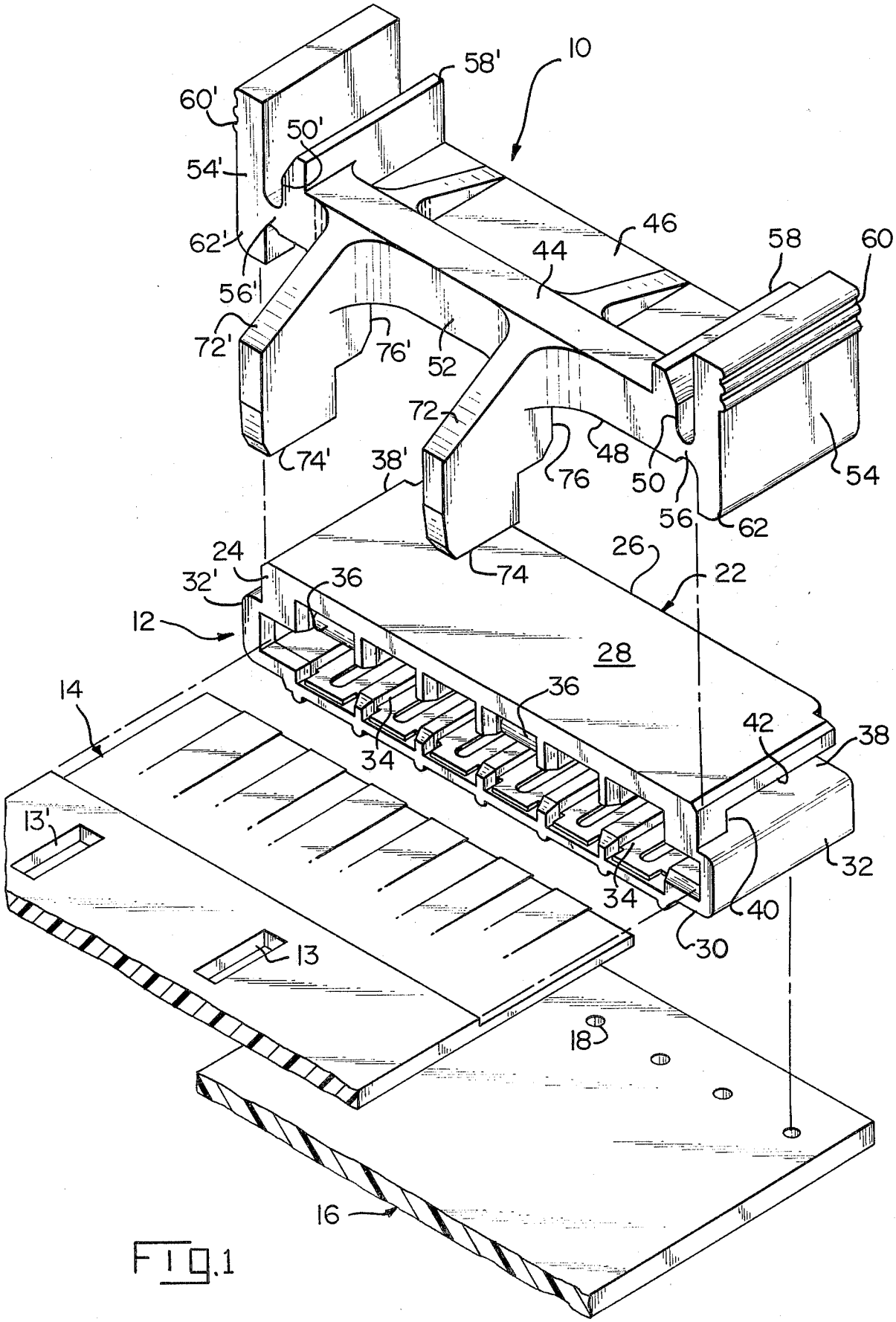
FIG. 1 is an exploded perspective view of a strain relief and multi-contact connector for flat multi-conductor cable in accordance with the present invention.
Figure 2:
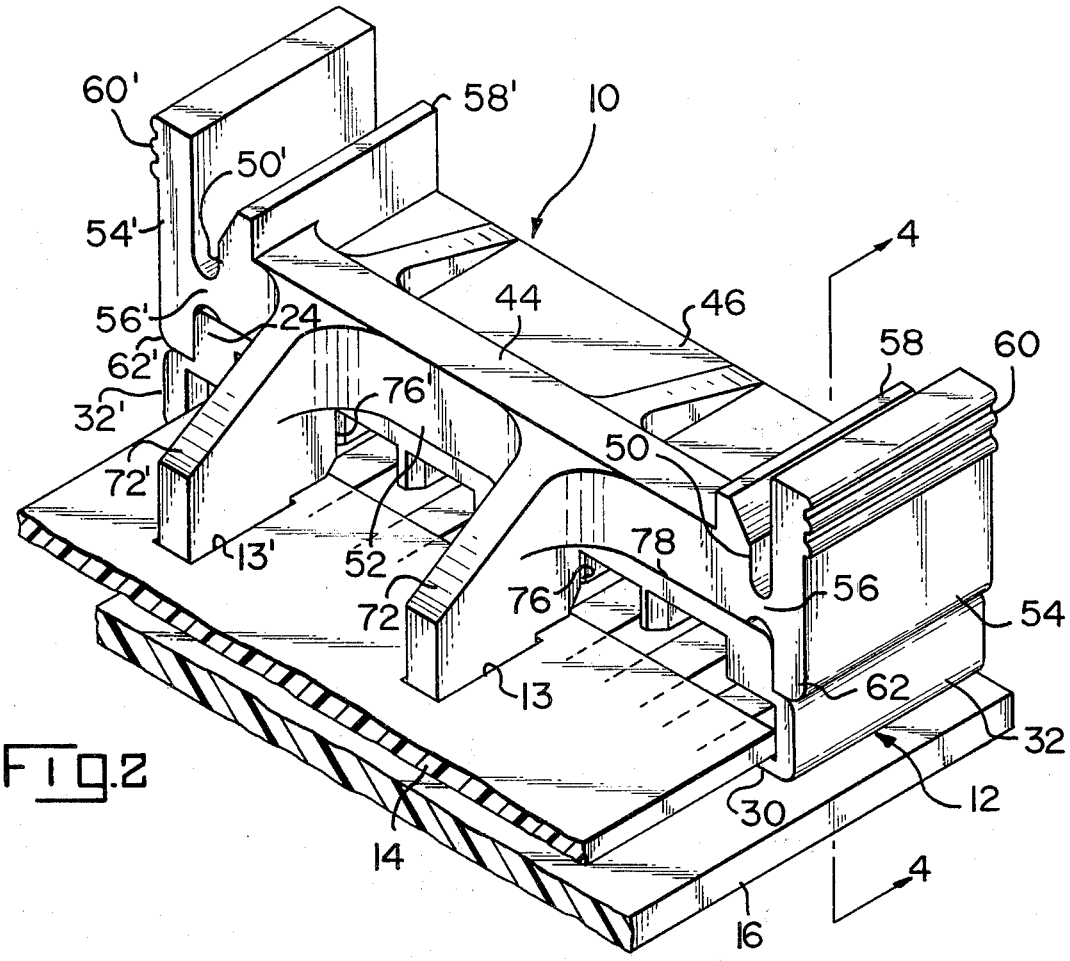
FIG. 2 is a perspective view of strain relief assembled to a connector in accordance with the present invention showing the connector mounted on a printed circuit board.
Figure 3:
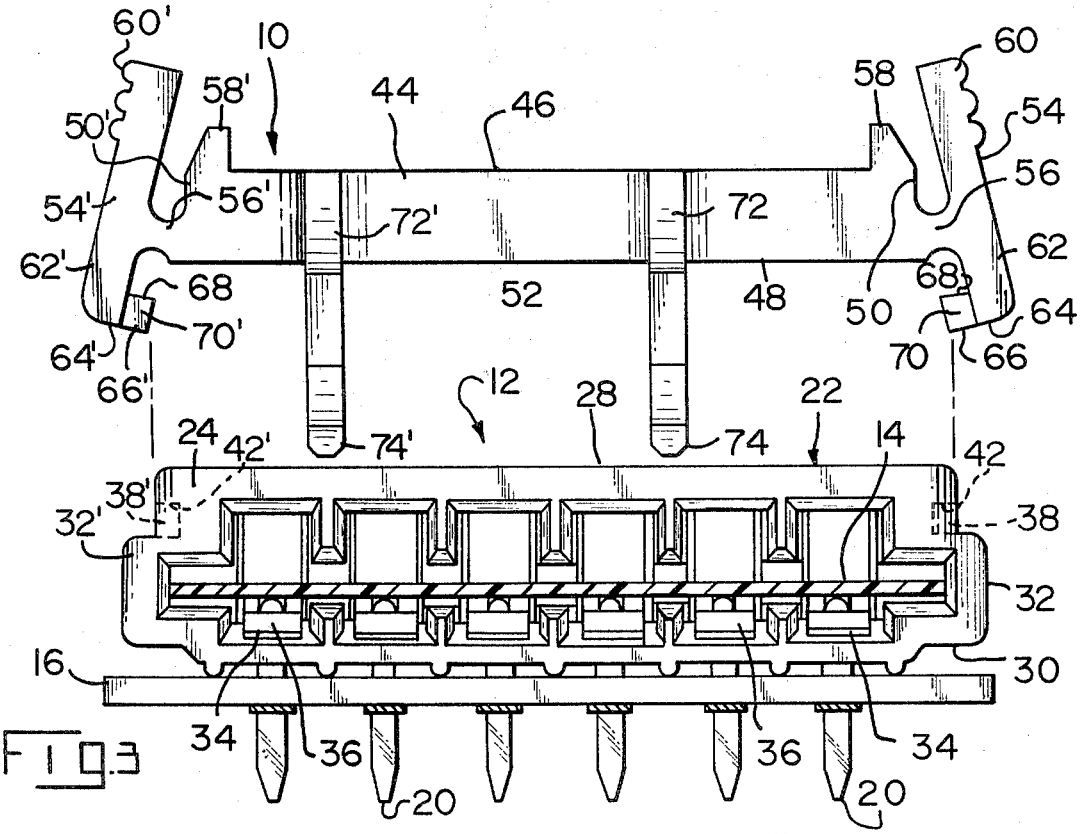
FIG. 3 is a front elevation showing retraction of the latching arms preparatory to mounting the strain relief on the connector.

A strain relief 10 in accordance with the present invention is mounted on a multi-contact electrical connector 12 and engaged with openings 13, 13' in a flat multi-conductor cable 14 to retain the cable in the connector 12. As shown in FIGS. 1–3, the invention contemplates the connector 12 being mounted on a printed circuit board 16 which is provided with apertures 18 to receive the terminal mounting tails 20.

The connector 12 is of the general type comprising an insulating housing 22 which has a cable-receiving face 24, a rearward face 26, upper and lower sidewalls 28, 30, as viewed in FIG. 1, and endwalls 32, 32'. A cable-receiving trough 34 extends into the housing 22 from the cable-receiving face 24. Mounted in the trough 34 are a plurality of contact terminals 36 arranged in a row extending between the endwalls 32, 32' so that when a multi-conductor cable 14 is inserted in the trough 34, the conductors in the cable 14 are each contacted by a terminal 36.

The connector 12 has a transverse groove 38, 38' on each endwall 32, 32'. The transverse grooves 38, 38' open toward the rearward face 26 and extend toward the cable-receiving face 24, thus permitting the connector housing 22 to be molded in a straight pull operation to minimize fabrication costs. Each transverse groove 38, 38' defines a rearwardly facing bearing surface 40, 40' at its end nearest the cable-receiving face 24 and a downwardly facing transverse shoulder 42, 42'.

The strain relief 10 comprises a rigid body portion 44 having top and bottom surfaces 46, 48, as viewed in FIG. 1, ends 50, 50', and a forward edge 52. Platelike latching arms 54, 54' are vertically disposed at the ends 50, 50' and connected thereto by flexible neck portions 56, 56' of thin cross section relative to the body portion 44 and latching arms 54, 54'. Projecting upwardly from each end 50, 50' is a latching arm stop 58, 58' which prevents excessive flexure of the latching arm 54, 54'.

Each latching arm 54, 54' comprises a finger portion 60, 60' extending upwardly from the intersection of the latching arm and neck portion 56, 56' and a latching portion 62, 62' extending downwardly from the intersection to a latching arm free end 64, 64'. A transverse latching ear 66, 66' on each latching arm free end 64, 64' projects inwardly therefrom to define an upwardly facing surface 68, 68' and a forwardly facing end 70, 70'. The latching ears 66, 66' are engagable with the transverse grooves 38, 38' on the housing endwalls 32, 32'.

Platelike cable-retaining ears 72, 72' extend forwardly and downwardly from the forward edge 52 of the strain relief body portion 44 to free end portions 74, 74'. Intermediate the forward edge 52 and free end portions 74, 74' are rearwardly facing bearing edges 76, 76'. For connectors having a large number of terminals, more than the two cable-retaining ears shown in the drawings, may be required.

Figure 4:
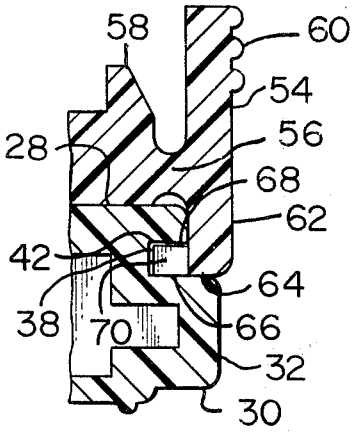
FIG. 4 is a detail section along the lines 4—4 of FIG. 2.

As shown in FIG. 3, the strain relief 10 is mounted on the connector 12 by first squeezing the latching arm finger portions 60, 60', permitting the latching ears 66, 66' to clear the connector housing endwalls 32, 32'. Forward-rearward alignment of the strain relief is achieved by inserting the cable-retaining ear free ends 74, 74' in the cable openings 13, 13'. The strain relief 10 is then pushed onto the connector housing 22 until the latching ears 66, 66' engage the transverse grooves 38, 38' on the housing endwalls 32, 32' as shown in FIG. 4. In this mounted position, the cable-retaining ears 72, 72' firmly engage the cable openings 13, 13' to prevent removal of the cable 14 from the cable-receiving trough 34. Movement of the strain relief 10 in relation to the connector 12 is prevented: in the forward direction by the rearwardly facing bearing surfaces 40, 40' engaging the forwardly facing ends 70, 70'; in the rearward direction by the rearwardly facing bearing edges 76, 76' bearing on the cable-receiving face 24; and in the upward direction by the downwardly facing transverse shoulders 42, 42' engaging the upwardly facing surfaces 68, 68'.

Figure 5:
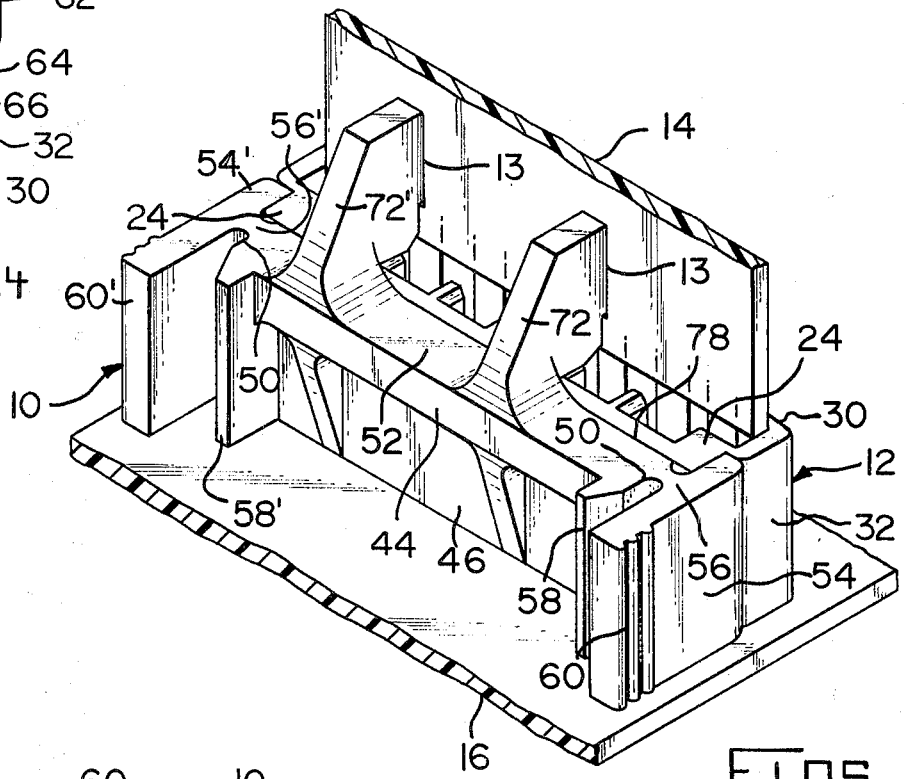
FIG. 5 is a perspective view of a strain relief and connector in accordance with the present invention vertically mounted on a printed circuit board.

The strain relief 10 and connector 12 as shown in FIGS. 2 and 3 are horizontally mounted on the printed circuit board 16. The present invention also permits the strain relief 10 and connector 12 to be vertically mounted on the printed circuit board 16 as shown in FIG. 5. In addition, the strain relief 10 may be mounted on a connector 12 after the connector has been positioned, either horizontally or vertically, on a printed circuit board 16, thus permitting conversion of a bare connector to a strain relief-connector combination without removing the connector from the board.

Figure 6:
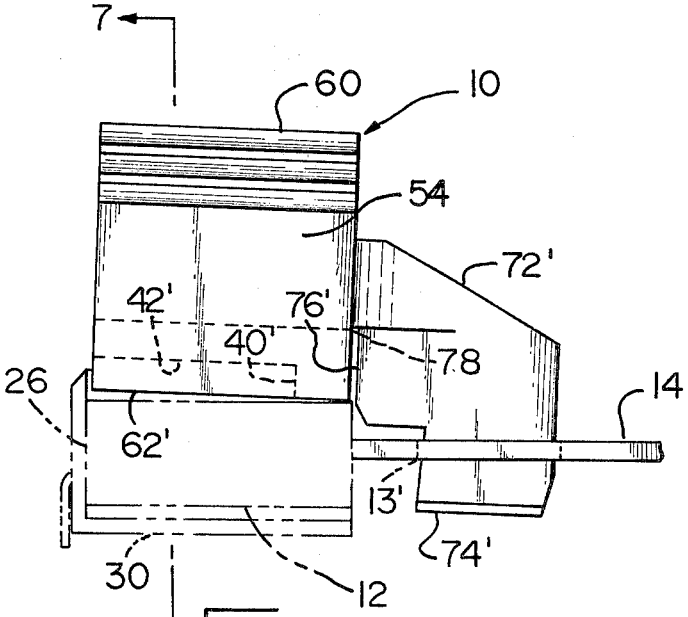
FIG. 6 is a side elevation view showing initial disengagement of the latching ear and connector housing groove in response to a predetermined tensile pull on the flat cable.
Figure 7:
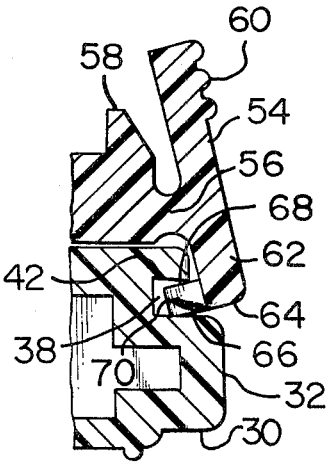
FIG. 7 is a detail section along the line 7—7 of FIG. 6.

To prevent damage to the cable 14, connector 12, or strain relief 10 upon application of an excessive tensile pull on the cable 14, the present invention provides an overload release mechanism. As shown in FIG. 6, a tensile pull on the cable 14 causes the strain relief 10 to pivot around an axis coincident with the line 78 formed by the adjacent strain relief forward edge 52 and housing cable-receiving face 24. As the strain relief 10 pivots, an upward force is placed on the latching ears 66, 66' having its greatest magnitude at the rearward end of the latching ears 66, 66' and decreasing toward the forward end. When this force reaches a predetermined level, the latching ears 66, 66' are flexed downward, forcing the latching portions 62, 62' outward in a camming action as shown in FIG. 7, until the latching ears 66, 66' disengage the transverse grooves 38, 38'. The strain relief 10 then pops off the connector 12, leaving all components undamaged.

What is claimed is:

1. A multi-contact electrical connector and strain relief for flat multi-conductor cable, said connector comprising an insulating housing having a cable-receiving face and a rearward face, upper and lower sidewalls and endwalls extending between said faces, a cable-receiving trough extending into said housing from said cable-receiving face, a plurality of contact terminals mounted in said trough, said terminals being arranged in a row extending between said endwalls so that the side-by-side conductors in said flat cable are contacted by said terminals when said cable is inserted into said trough, said connector and said strain relief being characterized in that said strain relief comprises:

a rigid body portion which is disposed against said upper sidewall, said body portion having ends which are adjacent to said endwalls and a forward edge adjacent to said cable-receiving face;

latching arms disposed against said endwalls, said latching arms having latching portions, said latching portions being in engagement with latching shoulders on said endwalls;

flexible neck portions connecting said latching arms to said ends of said body portion, said neck portions permitting outward movement of said latching portions from said endwalls, so that said latching portions can be disengaged from said latching shoulders and said strain relief can thereby be separated from said connector; and at least two cable-retaining ears extending laterally from said forward edge of said body portion, said cable-retaining ears having free end portions which are received in openings in said cable whereby, removal of said cable from said trough is prevented.

2. A connector and strain relief according to claim 1, characterized in that said connector and strain relief have overload release means, said overload release means comprising camming surface portions on said latching portions and said latching shoulders, said camming surface portions permitting disengagement of said latching portions and latching shoulders in response to a predetermined tensile pull on said cable whereby, damage to said connector, said strain relief, and said cable is prevented.

3. A connector and strain relief according to claim 1, characterized in that each said latching shoulder comprises a transverse groove, each said transverse groove opening toward said rearward face of said housing and extending toward said cable-receiving face of said housing, each said transverse groove defining a rearwardly facing bearing surface at the forward end of said transverse groove, each said transverse groove defining a downwardly facing transverse shoulder.

4. A connector and strain relief according to claim 3, characterized in that each said latching arm is a platelike member comprising a finger portion extending upwardly from the intersection of said latching arm and said neck portion, said latching portion extending downwardly to a free end from the intersection of said latching arm and said neck portion, and a transverse latching ear on said free end of said latching portion, said latching ear projecting inwardly from the inner surface of said latching portion, said latching ear having an upwardly facing surface and a forwardly facing end, said latching ear being in engagement with said transverse groove whereby, said upwardly facing surface of said latching ear engages said downwardly facing shoulder of said transverse groove to prevent upward movement of said strain relief in relation to said housing and, said forwardly facing end of said latching ear engages said rearwardly facing bearing surface of said transverse groove to prevent movement of said strain relief toward said cable-receiving face.

5. A connector and strain relief according to claim 4, characterized in that said connector and strain relief have overload release means, said overload release means comprising said downwardly facing shoulders of said transverse grooves and said upwardly facing surfaces of said latching ears cooperating as camming surfaces to force said latching portions away from said endwalls in response to a predetermined tensile pull on said cable whereby, said latching ear and said transverse groove are disengaged, thereby preventing damage to said connector, said strain relief, and said cable.

6. A connector and strain relief according to claim 1, characterized in that said cable-retaining ears are platelike members extending forwardly and downwardly from said forward edge of said body portion, said cable-retaining ears comprising said free end portions which are received in openings in said cable, and rearwardly facing bearing edges intermediate said free end portions and said forward edge, said bearing edges bearing on said cable-receiving face of said housing to prevent rearward movement of said strain relief in relation to said housing.

7. A strain relief mountable on a multi-contact electrical connector for flat multi-conductor cable, said connector comprising an insulating housing having a cable-receiving face and a rearward face, upper and lower sidewalls and endwalls extending between said faces, a cable-receiving trough extending into said cable-receiving face, a plurality of contact terminals mounted in said trough, said terminals being arranged in a row extending between said endwalls so that the side-by-side conductors in said flat cable are contacted by said terminals when said cable is inserted into said trough, characterized in that said strain relief comprises:

a rigid body portion, said body portion having ends and a forward edge extending between said ends so that when said strain relief is mounted on said connector, said body portion is disposed against said upper sidewall, said ends are adjacent to said endwalls, and said forward edge is adjacent to said cable-receiving face;

latching arms, said latching arms having latching portions so that when said strain relief is mounted on said connector, said latching arms are disposed against said endwalls, and said latching portions are in engagement with latching shoulders on said endwalls;

flexible neck portions connecting said latching arms to said ends of said body portion, said neck portions permitting outward movement of said latching portions so that when said strain relief is mounted on said connector, said latching portions can be disengaged from said latching shoulders and said strain relief can thereby be separated from said connector; and at least two cable-retaining ears extending laterally from one side edge of said body portion, said cable retaining ears having free end portions receivable in openings in said cable whereby, when said strain relief is mounted on said connector, removal of said cable from said trough is prevented.

8. A strain relief according to claim 7, characterized in that each said latching arm is a platelike member comprising a finger portion extending upwardly from the intersection of said latching arm and said neck portion, a latching portion extending downwardly to a free end from the intersection of said latching arm and said neck portion, and a transverse latching ear on said free end of said latching portion, said latching ear projecting inwardly from the inner surface of said latching arm, said latching ear having an upwardly facing surface and a forwardly facing end whereby, when said strain relief is mounted on said connector, said latching ears engage said latching shoulders, each said latching shoulder comprising a transverse groove, each said transverse groove opening toward said rearward face of said connector housing and extending toward said cable-receiving face of said housing, so that said upwardly facing surface of each said latching ear engages a downwardly facing shoulder defined by each said transverse groove to prevent upward movement of said strain relief in relation to said housing, and said forwardly facing end of each said latching ear engages a rearwardly facing bearing surface at the forward end of each said transverse groove to prevent movement of said strain relief toward said cable-receiving face.

9. A strain relief according to claim 8, characterized in that said strain relief has overload release means, said overload release means comprising said upwardly facing surfaces of said latching ears whereby, when said strain relief is mounted on said connector, said upwardly facing surfaces cooperate with said downwardly facing shoulders of said transverse grooves as camming surfaces to force said latching portions away from said endwalls in response to a predetermined tensile pull on said cable so that said latching ear and said transverse groove are disengaged.

10. A strain relief according to claim 7, characterized in that said cable retaining ears are platelike members extending forwardly and downwardly from said forward edge of said body portion, said cable retaining ears comprising said free end portions, and rearwardly facing bearing edges intermediate said free end portions and said forward edge whereby, when said strain relief is mounted on said connector, said free end portions are received in openings in said cable and said bearing edges bear on said cable-receiving face of said housing to prevent rearward movement of said strain relief in relation to said housing.

* * * * *